US005678316A

United States Patent [19]

Althaus et al.

[11] Patent Number: 5,678,316

[45] Date of Patent: Oct. 21, 1997

[54] DISPOSABLE RAZOR

[75] Inventors: Wolfgang Althaus, Wuppertal; Michael Schwarz, Heide, both of Germany

[73] Assignee: Warner-Lambert Company, Morris Plains, N.J.

[21] Appl. No.: 572,953

[22] Filed: Dec. 15, 1995

[51] Int. Cl.[6] ..... B26B 21/56; B26B 21/60

[52] U.S. Cl. ..... 30/527; 30/340

[58] Field of Search ..... 30/526, 527, 528, 30/531, 532, 340; 16/110 R

[56] References Cited

U.S. PATENT DOCUMENTS

| | | | |
|---|---|---|---|
| 1,015,575 | 1/1912 | Meyer . | |
| 1,107,538 | 8/1914 | McDermott . | |
| 2,083,172 | 6/1937 | Smith . | |
| 2,844,870 | 7/1958 | Roces et al. . | |
| 3,823,471 | 7/1974 | Stone . | |
| 4,152,828 | 5/1979 | Lund . | |
| 4,281,456 | 8/1981 | Douglass et al. . | |
| 4,955,136 | 9/1990 | Diaz-Rivera . | |
| 5,027,511 | 7/1991 | Miller . | |
| 5,038,472 | 8/1991 | Iderosa | 30/527 |
| 5,168,628 | 12/1992 | Mock et al. . | |
| 5,402,574 | 4/1995 | Milner . | |
| 5,560,106 | 10/1996 | Armbruster et al. | 30/527 |

*Primary Examiner*—Douglas D. Watts
*Attorney, Agent, or Firm*—Charles W. Almer

[57] ABSTRACT

It is an object of the present invention to improve the shave performance of a razor of the above mentioned type by providing a pressure sensitive razor design. In addition the handling is improved. A solution for the above mentioned object is characterized in that the resilient connection is shaped in an arcuate line between the handle and the blade unit and the blade unit can be fixed to the connection such that at least one blade is positioned in a plain that is approximately rectangular to a tangent line of the arcuate line of the connection at an end portion where the blade unit can be fixed.

14 Claims, 2 Drawing Sheets

DISPOSABLE RAZOR

FIELD OF THE INVENTION

The present invention is directed to a razor, especially a disposable blade razor, comprising a handle, a blade unit including at least one blade and a resilient connection between the handle and the blade unit.

BACKGROUND OF THE INVENTION

Razors, especially disposable razors, are an important segment of the shaving market. Experience has proven that consumers' expectations for good shaves have risen over the years. Various forms of disposable razors are well known in the art.

One group of razors, which are non-disposable, are disclosed in U.S. Pat. Nos. 495,513; 2,083,172 and 2,844,870. These publications disclose safety razors having tubular resilient handles, such as helical resilient wire springs. The purpose of such a handle was to provide a suitable degree of flexibility causing the blade to move over the face with a "drawing" action instead of the usual "scraping" action and thereby resulting in a much improved shave. The publications disclose the additional use of rigid sleeves and the possibility of adjusting the spring by positioning it in a longitudinal direction of the sleeve.

A second type of razor is disclosed in the U.S. Pat. Nos. 1,015,575; 3,823,471; 5,402,574 and 5,038,472. These publications, which refer to non-disposable razors, disclose razors having a resilient portion interconnecting a handle grip portion and a blade portion. This resilient area is made in the form of a coiled spring. More specifically, U.S. Pat. No. 3,823,471 discloses the use of a tapered portion, U.S. Pat. No. 5,402,574 discloses the use of a tubular rubber member and U.S. Pat. No. 5,038,472 discloses the use of a combination of flexures and a guide pin. Further, the use of a non-flexible, but bendable portion is disclosed in U.S. Pat. No. 4,955,135. A compressible grip is disclosed in U.S. Pat. No. 5,027,511.

Today it is evident that razor users, especially the users of disposable razors, are not willing to pay an extra premium price for sophisticated razors containing moveable blades and the like. Nevertheless since expectations for improved shave quality are rising, technical improvements should be incorporated wherever possible into modern low-price razors, especially disposable razors, if they can improve shave performance with low extra cost.

Analysis has shown that when the pressure a user applies during shaving is too high nicks and cuts may result, which are discomforting for the user. On the other hand, it is also important to provide a solid grip for the user to hold during use because a high quality shave is often the result of a sufficient handling process. Therefore, it is an object of the present invention to improve the shave performance of a razor of the above mentioned type by providing a pressure sensitive razor design. In addition, the handling of the razor is improved by the present invention. Further, the present invention provides the above described improvements in a way which allow for low cost manufacturing and therefore are particularly suitable for disposable razors.

SUMMARY OF THE INVENTION

A solution for the above mentioned object according to the present invention involves the addition of a resilient connection, which is shaped in an arcuate line, between the handle and the blade unit. The blade unit can be fixed to the connection such that at least one blade is positioned in a plane that is approximately rectangular to a tangent line of the arcuate line of the connection at an end portion where the blade unit can be fixed.

With the above mentioned solution a razor, especially a disposable blade razor, comprising a handle, a blade unit including at least one blade, and a resilient connection between the handle and the blade unit can be improved with regard to the shave performance and with regard to the handling by providing a special design of the connection. Due to the fact that the connection is shaped in an arcuate line and the blade unit can be fixed in a predetermined position the resulting forces from the implementation of pressure on the blade unit can be directed in a predetermined direction crossing the longitudinal axis of the handle. As the connection is shaped in a arcuate line the resulting forces are reduced by the deformation of the arcuated connection which changes its radius in response to the acting forces.

According to a preferred embodiment of the invention the connection can be shaped in a double arcuate line. This means, that two bows with opposite directions or opposite centers are provided, so that the spring characteristic of the connection is enhanced. One of the arcuate lines will be on the tension side, the other one on the compression side when pressure forces work on the blade unit during a shave.

According to a further preferred embodiment of the invention the connection is designed/constructed of the same material as the handle. According to a different proposal the connection can be made of two different materials with different spring characteristics. This proposal provides an advantage with regard to the resilience of the connection, especially when using a double arcuate line.

According to a further embodiment of the invention, one of the two different materials is a solid standard plastic, while the other one is a soft material which provides a great pressure sensitivity. According to an additional embodiment of the invention the soft materials can be rubber or similar materials. The solid standard plastic material is, according to one preferred embodiment of the invention, positioned on the tension side of the connection. The pressure sensitive material on the outside will provide a better grip if a finger is resting in the arcuate area to provide controlled pressure during shave.

The connection can be produced with a reduced thickness compared with the average thickness of the handle. The connection can have the form of a flexure strip. Such a flexure strip can have a wave form according to one embodiment of the invention. The wave form can include a straight center bow.

According to a further preferred embodiment of the invention, the soft material can be continued along the side of at least one surface of the handle. This provides a soft solid finger grip.

With the use of the razor of the present invention, the shave performance is impacted by enhancing proper handling during shaving and it is obvious that a tactile haptic design provides this best. The razor according to the invention, especially the disposable, can be used by men and women. Women sometime use disposable razors for body shave and the way of handling is certainly different. They prefer a mere fingertip control, where the forefinger rests on the razor neck. The razor according to the invention offers this opportunity very well. The special design of the connection that provides a bowline razor neck improves the shave performance by providing a pressure sensitive element.

The present invention allows the introduction of a new technical development on a very low price and without uneconomic revisions of the production lines. Further features and advantages will be realized by the man skilled in the art by the following description.

DETAILED DESCRIPTION OF THE PREFERRED EMBODIMENTS

Figure 1:
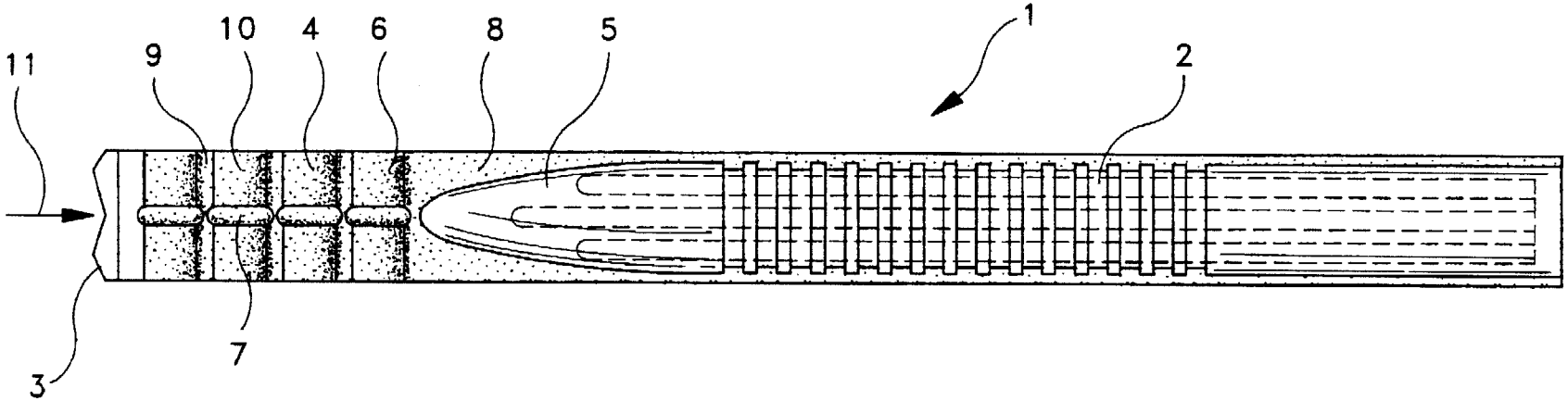
FIG. 1 is a top view of an embodiment of the disposable handle of the present invention.
Figure 2:
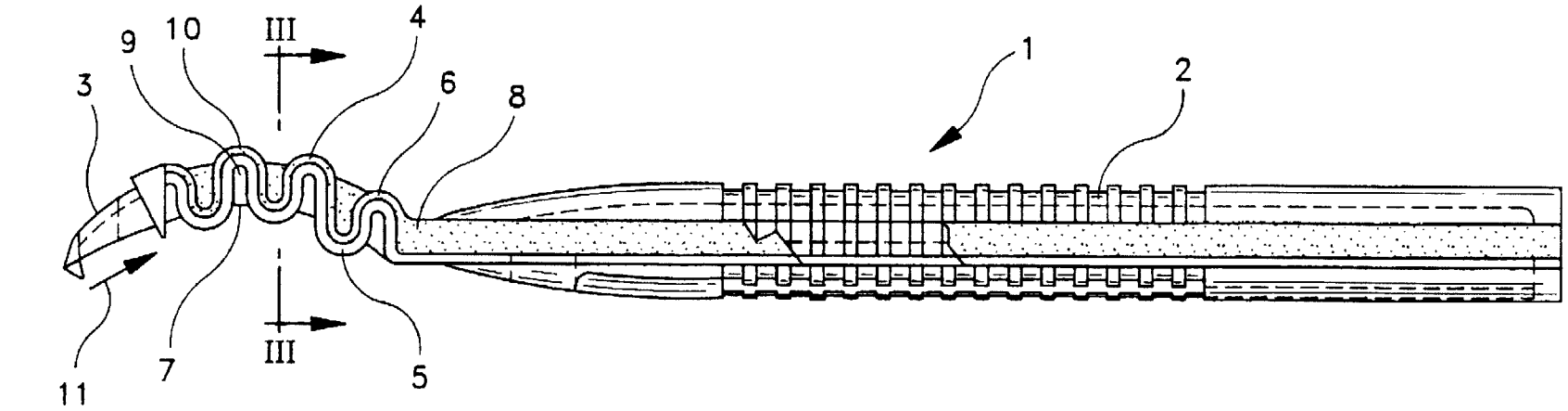
FIG. 2 is a side view of the handle of the present invention.

FIGS. 1 and 2 illustrate a razor handle 1 which is especially for a disposable razor, comprising a grip portion 2, a joining end 3 for joining a blade unit (not shown) and a connection section 4 which is a resilient connection. It can be seen that at least two materials are used for the connection section, including standard plastic material 5 as well as a soft material 6. The standard plastic 5 can be made of a material such as medium impact polystyrene. The soft material can be, for example, a rubber type TPE material high flow of the D-series with a hardness of 60A on the Shore scale or with a hardness sufficient to produce the desired amount of flex.

The illustrated connection includes one arcuate portion 7 and a second arcuate portion 8, so that an S-shape design is formed. The arcuate portions include a straight center 9 and, on both sides thereof, a wave form strip 10, so that a flexure strip is made. The arrow 11 shows the pressure line which is in the direction of pressure forces implemented on the blade unit. The blade unit may be of the well known type where a small housing includes one or more razor blades.

It is obvious that forces working on the blade unit will be reduced in the arcuate portion. The arcuate portion 7 is on the tension side, the arcuate portion 8 on the compression side. Due to the form and the selection of the materials both arcuate portions are deformed with regard to their radii in response to the forces encountered during shaving so that pressure forces are reduced easily.

In the illustrated embodiment the soft material 6 is also used on the grip portion 2, so that this grip provides a minimum ability of compression but provides a mere fingertip control where the forefinger rests on the razor neck.

The arrow 11 shows, especially in FIG. 2, that the pressure forces are introduced into the connection in a central axis line of the arcuate portion 7. This introduction is achieved by the fact that the blade unit can be fixed to the joining end 3 such that at least one blade is positioned in a plane that is approximately rectangular to the central axis line.

Figure 3C:
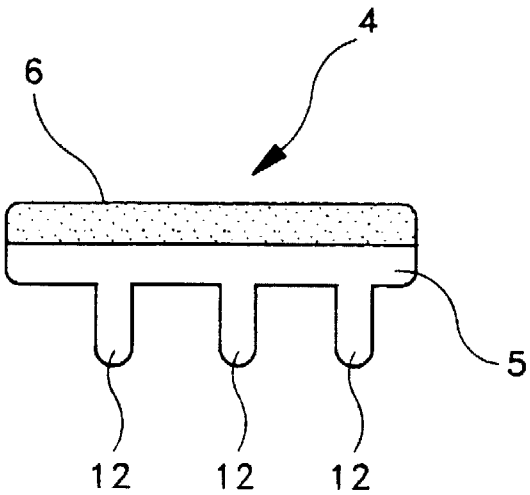
FIGS. 3*a*–3*c* are schematic sectional views along line III—III in FIG. 2.
Figure 3B:
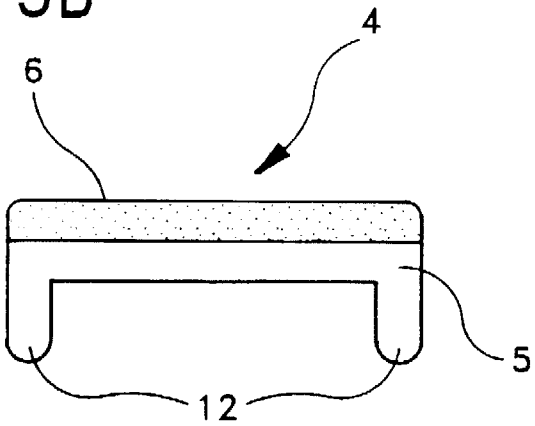
Figure 3A:
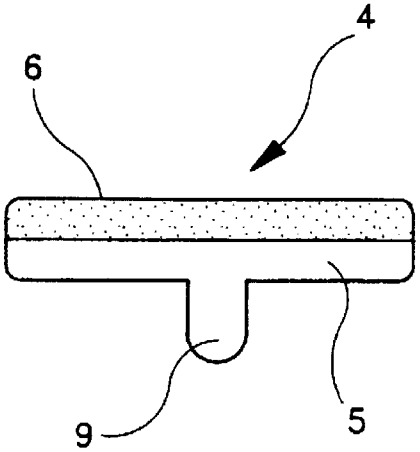

FIGS. 3*a* to 3*c* illustrate several embodiments of the arcuate portions of the connection section. The embodiment according to FIG. 3*a* includes one straight center 9 in the area made out of solid material, for example standard plastic 5. On the other side soft material 6 is used. In the embodiment according to FIG. 3*b*, two bows 12 are used on both sides of longitudinal center line of the handle. In the embodiment according to FIG. 3*c* three bows 12 are used.

We claim:

1. A disposable razor comprising a handle, a blade unit having at least one blade, a resilient connection between the handle and the blade unit, and a relatively straight center portion.

2. A disposable razor according to claim 1, wherein the blade unit can be affixed to the resilient connection such that at least one blade is positioned in a plane that is approximately perpendicular to a central axis line in the plane parallel to the arcuate line of the resilient connection.

3. A disposable razor according to claim 2, wherein the resilient connection comprises the same material as the handle.

4. A disposable razor according to claim 2, wherein the resilient connection comprises a first material with a first resiliency and a second material with a second resiliency.

5. A disposable razor according to claim 4, wherein the first material comprises a relatively inflexible plastic and the second material comprises a soft, resilient material.

6. A disposable razor according to claim 5, wherein the soft material comprises a rubber-like material.

7. A disposable razor according to claim 5, wherein the solid plastic is positioned on a tension side of the resilient connection.

8. A disposable razor according to claim 1, wherein the resilient connection has a thickness less than that of the handle.

9. A disposable razor according to claim 8, wherein the resilient connection comprises a flexure strip.

10. A disposable razor according to claim 8, wherein the resilient connection comprises a wave form element.

11. A disposable razor according to claim 8, wherein the resilient connection comprises at least one bow.

12. A disposable razor according to claim 11, wherein the at least one bow is a center bow.

13. A disposable razor according to claim 12, wherein the at least one center bows provide the resiliency.

14. A disposable razor according to claim 5, wherein the soft material is also located on at least one surface of the handle.

* * * * *